US006494542B1

(12) United States Patent
Watt

(10) Patent No.: US 6,494,542 B1
(45) Date of Patent: Dec. 17, 2002

(54) APPARATUS FOR ROUGHENING CONCRETE SLAT SURFACES

(75) Inventor: Ronald Bruce Watt, Ingersoll (CA)

(73) Assignee: Agri-Trac Inc., Woodstock (CA)

( * ) Notice: Subject to any disclaimer, the term of this patent is extended or adjusted under 35 U.S.C. 154(b) by 0 days.

(21) Appl. No.: 09/714,264

(22) Filed: Nov. 17, 2000

(51) Int. Cl.[7] ..... B24B 23/00

(52) U.S. Cl. ..... 299/39.4; 299/36.1; 451/350; 280/503

(58) Field of Search ..... 299/36.1–41.1; 280/32.7, 498, 503; 451/350–353

(56) References Cited

U.S. PATENT DOCUMENTS

| | | | | | |
|---|---|---|---|---|---|
| 1,044,903 | A | * | 11/1912 | Myers | 280/503 |
| 1,087,210 | A | * | 2/1914 | Bryan | 280/503 |
| 1,107,763 | A | * | 8/1914 | Dain | 280/498 |
| 1,478,041 | A | * | 12/1923 | Lorenz | 280/503 |
| 1,555,171 | A | * | 9/1925 | Ulevog | 280/503 |
| 2,584,738 | A | * | 2/1952 | Reitz | 451/303 |
| 3,156,231 | A | * | 11/1964 | Harding | 299/36.1 |
| 3,161,994 | A | * | 12/1964 | Neitzer | 451/350 |
| 3,575,250 | A | * | 4/1971 | Dykes | 180/11 |
| 3,797,600 | A | * | 3/1974 | Miner | 180/64 |
| 4,523,361 | A | * | 6/1985 | Dummermuth | 29/71 |
| RE34,822 | E | * | 1/1995 | Mattson | 180/11 |
| 5,718,534 | A | * | 2/1998 | Neuling | 404/94 |
| 5,908,224 | A | * | 6/1999 | Santos | 299/39.2 |
| 6,328,387 | B1 | * | 12/2001 | Cooper et al. | 299/39.6 |
| 2001/0002627 | A1 | * | 6/2001 | Mattson et al. | 180/19.2 |

* cited by examiner

*Primary Examiner*—Heather Shackelford
*Assistant Examiner*—John Kreck

(57) ABSTRACT

A milling apparatus for preparing concrete floor surfaces consists of rear wheel motorized cart connected in tandem to a traction milling machine having a frame mounted drum for milling engagement with the floor and forward and rearward means for vertically adjusting the frame attached forward wheel means and rearward wheel means with reference to the floor. The forward wheel means includes a ski element and the rearward wheel means includes a wheeled dolly arrangement. The tandem connection consists of a specialized horizontally articulated hitch which transfers a portion of the weight of the motorized cart to the rear axle of the traction milling machine. An operator sits on the motorized cart and operates and steers the traction milling machine which includes motor means for powering said cart and the traction machine and steering means.

11 Claims, 10 Drawing Sheets

APPARATUS FOR ROUGHENING CONCRETE SLAT SURFACES

BACKGROUND OF THE INVENTION

In the agricultural industry, hoofed livestock are typically housed on smooth concrete floors. This has caused the problem of livestock not having a sure footing, as such floors do not provide sufficient traction. The livestock, as for example dairy cows, slip on these types of floors causing falls and injury. These injuries can be severe enough that the animal must be humanely put down. The slick flooring also causes undue stress on the livestock, thereby effectively reducing the animals feed intake, production, weight, and overall health. These disadvantages associated with smooth concrete flooring increase costs to the owner of the livestock because of lost production and increased veterinary and nutritional needs.

For many years the agricultural industry has attempted to address the problems set out above with marginal success. For example, a process of power toweling a new barn floor to make it smooth and flat and then saw cutting grooves in the concrete has been used for many years. There are several disadvantages associated with this method including its complexity involving several steps and difficulty in obtaining a consistent and uniform finish.

Sandblasting has also been used to roughen concrete floor surfaces. Sandblasting, however, only temporarily fixes the problem for a period of about a year because the texture tends to wear off. Yet another floor treatment involves using a demolition hammer to apply a texture to the concrete floor surface. This ad hoc method often results in damage to the floor and does not result in a consistent or uniform floor surface.

These prior art surface preparation applications have been used for slatted floors as well. However, when a slat has had, for example, the grooving method applied to it, the manufacturer of the slats voids the warranty claiming that the process of saw cutting grooves into slats reduces their structural integrity with the likelihood of making the slats unsafe for livestock traffic. As such, the farmer typically refuses this option and the livestock is no further ahead.

Accordingly, the need exists for an apparatus for preparing the surface of a concrete floor in such a way as to solve the problems outlined above. Moreover, the need exists for an apparatus which can be used to prepare both flat and slatted types of floors. Such preparation must be aggressive enough so as to supply excellent footing for the livestock, but not so aggressive as to cause discomfort to the animals or affect the structural integrity of the floor. A preparation process which removes approximately one-eighth (1/8) of an inch from the floor surface is believed to be preferable and not to affect the structural integrity thereof.

The present invention, which is a milling apparatus for preparing concrete surfaces, achieves all of the objectives described above. The floor surface prepared using the milling apparatus is not so rough as to cause undue hoof abrasion, while still providing traction to supply sure footing to the livestock. This prepared floor surface promotes livestock comfort, which in turn increases feed intake, herd health and production. As well, the prepared floor surface positively factors by reducing cull rates and foot and leg problems. Furthermore, because of the reductions in injuries and deaths, the insurance industry should take note of the advantages associated with the use of the milling apparatus. Its use may ultimately reduce insurance premiums for the farmer.

SUMMARY OF THE INVENTION

It is an object of the present invention to provide a milling apparatus for preparing concrete floor surfaces to provide better traction and sure footing for livestock, in particular hoofed livestock. It is a further object of the present invention to provide a milling apparatus for preparing both flat and slatted floor surfaces.

The objects of the present invention are achieved by means of a milling apparatus comprised of a rear wheeled motorized cart connected in tandem to a traction milling machine. More specifically, the motorized cart and traction milling machine are connected by means of a specialized articulated hitch. The present invention and its constituent elements are hereinafter described.

The traction milling machine comprises a frame on which a drum is mounted. The drum has attached to its periphery a plurality of teeth for milling engagement with a floor surface. For other applications, the drum may be comprised of a plurality of saw-blades in vertical alignment, for example, for use on a rubber matted floor. Attached to the front end of the frame are forward wheel means and attached to the rearward end of the frame are rearward wheel means on which the machine moves. The forward wheel means have attached thereto forward adjustment means to vertically adjust the forward wheel means with reference to the frame. Similarly, the rearward wheel means comprising an axle have attached thereto rearward adjustment means to vertically adjust the rearward wheel means with reference to the frame. The independent forward and rearward adjustment means are used to selectively control and adjust the depth of the engagement of the drum with the floor surface. Furthermore, an extension of the frame has attached thereto operator steering means, which in one embodiment extend outwardly and rearwardly from the frame extension in the form of handles.

For use on a slatted floor, the forward wheel means described above incorporate a ski element which may be lowered into engagement with the floor surface. As well, the rearward wheel means incorporate a dolly arrangement comprising at least two longitudinally aligned wheels within a rigid frame housing. The use of the ski and dolly arrangement ensures that the traction milling machine is able to operate in a level fashion over the spaces between slots both longitudinally and transversely, thereby helping to maintain consistent and uniform contact between the drum and the floor surface.

The motorized cart has a seat for the operator and motor means to provide power to the cart to propel the cart and the traction milling machine both forwardly and rearwardly over the floor surface. The seat is located such that the operator is able to easily access the steering means as well as the forward and rearward adjustment means.

The traction milling machine and motorized cart are attached in tandem by means of specialized articulated hitch. The first portion of the hitch is pivotally mounted onto the rear axle of the traction milling machine for the purpose of weight transfer later described. The complementary second portion of the hitch is attached to the front of the motorized cart. The first hitch portion and the complementary second hitch portion are connected by means of a pin to form an articulated hitch. During operation, the articulated hitch permits the milling apparatus to be steered in response the operator's control of the steering means and movement of the motorized cart. In effect, the milling apparatus is steered by means of directing the traction milling machine in the desired direction of travel. Essentially, the rear wheels of the traction milling machine act as the front wheels of the cart.

Importantly, the articulated hitch is further adapted to transfer a portion of the weight of the motorized cart and operator to the traction milling machine hereinafter referred to as weight transfer. Weight transfer greatly assists in keeping the traction milling machine in continuous engagement with the floor surface to provide a consistent and uniform textured finish to the floor.

BRIEF DESCRIPTION OF DRAWINGS

In order that the invention may be more clearly understood, a preferred embodiment thereof will now be described in detail by way of example, with reference to the accompanying drawings, in which.

PREFERRED EMBODIMENT

The present invention relates to a milling apparatus for preparing concrete floor surfaces to provide better traction and sure footing for livestock, in particular hoofed livestock. The present invention further relates to a milling apparatus for use in the preparation of both flat and slatted floor surfaces.

Figure 1:
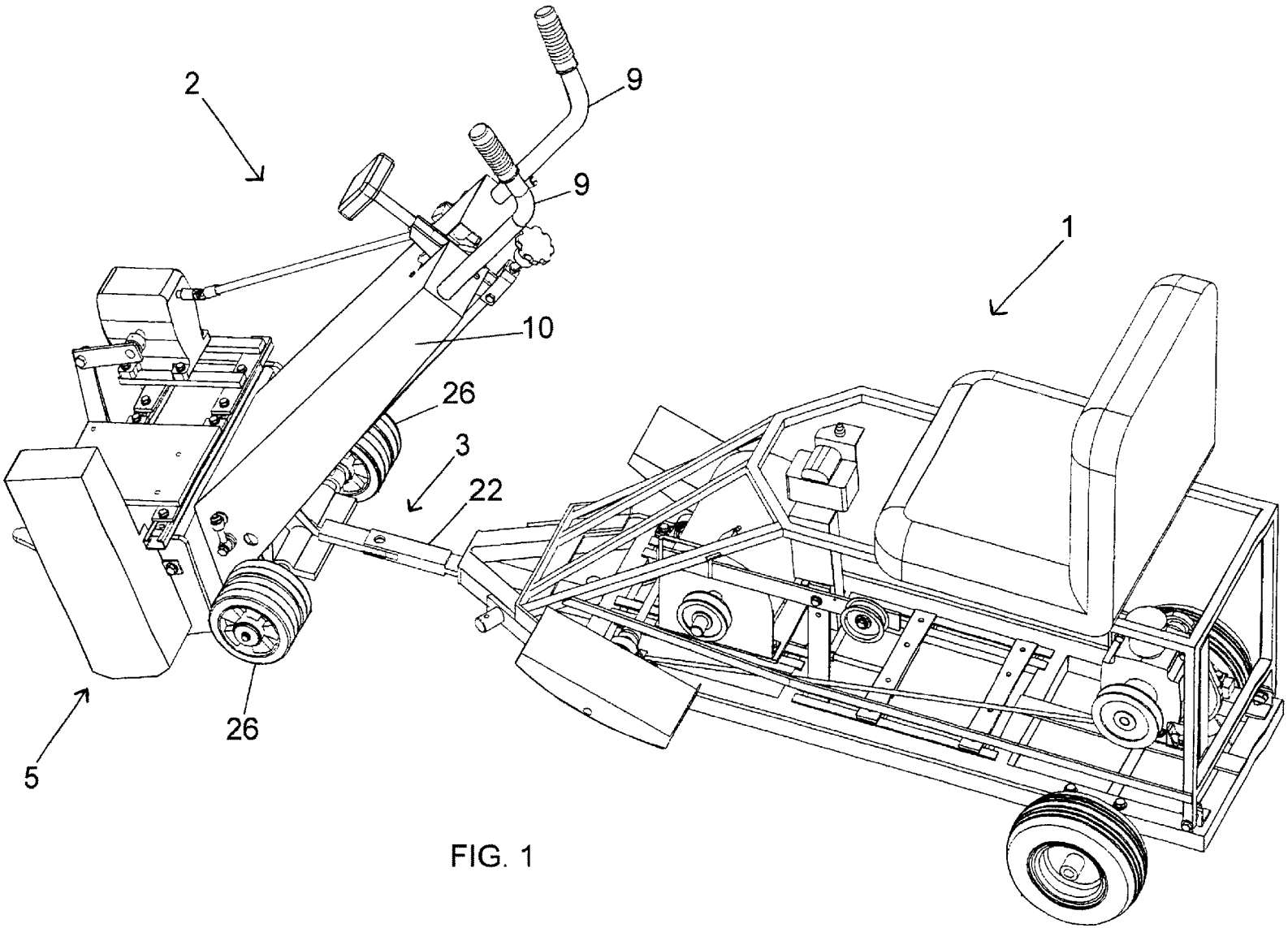
FIG. 1 is a perspective view of the milling machine according to this invention.
Figure 2:
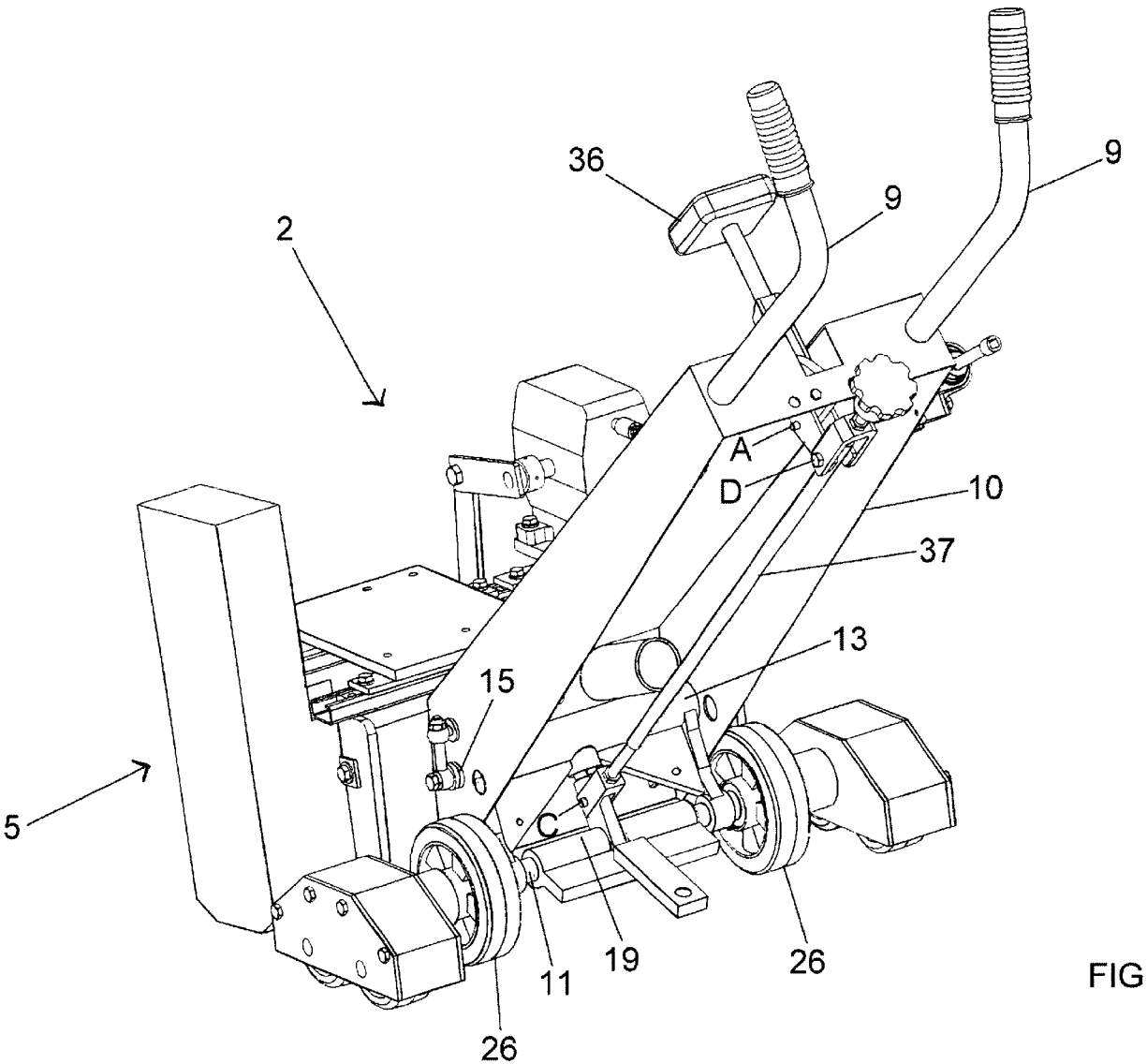
FIG. 2 is a perspective view of the traction milling machine.

Referring to FIGS. 1 and 2, the milling apparatus consists of a rear wheeled motorized cart 1 connected in tandem to a traction milling machine 2 having a frame 5 and frame extension 10. The motorized cart 1 is connected to the traction milling machine 2 by means of a specialized articulated hitch 3, which is made to pivot in the horizontal plane. In the preferred embodiment, the traction milling machine is positioned forward of the motorized cart. The traction milling machine 2 has means for vertical adjustment of the machine with reference to the floor surface, such that the operator may control and selectively adjust the depth of milling operations which will be described with reference to FIGS. 2, 3, 6, 7, and 8. Each of the constituent elements of the preferred embodiment is hereinafter described in greater detail.

Figure 3:
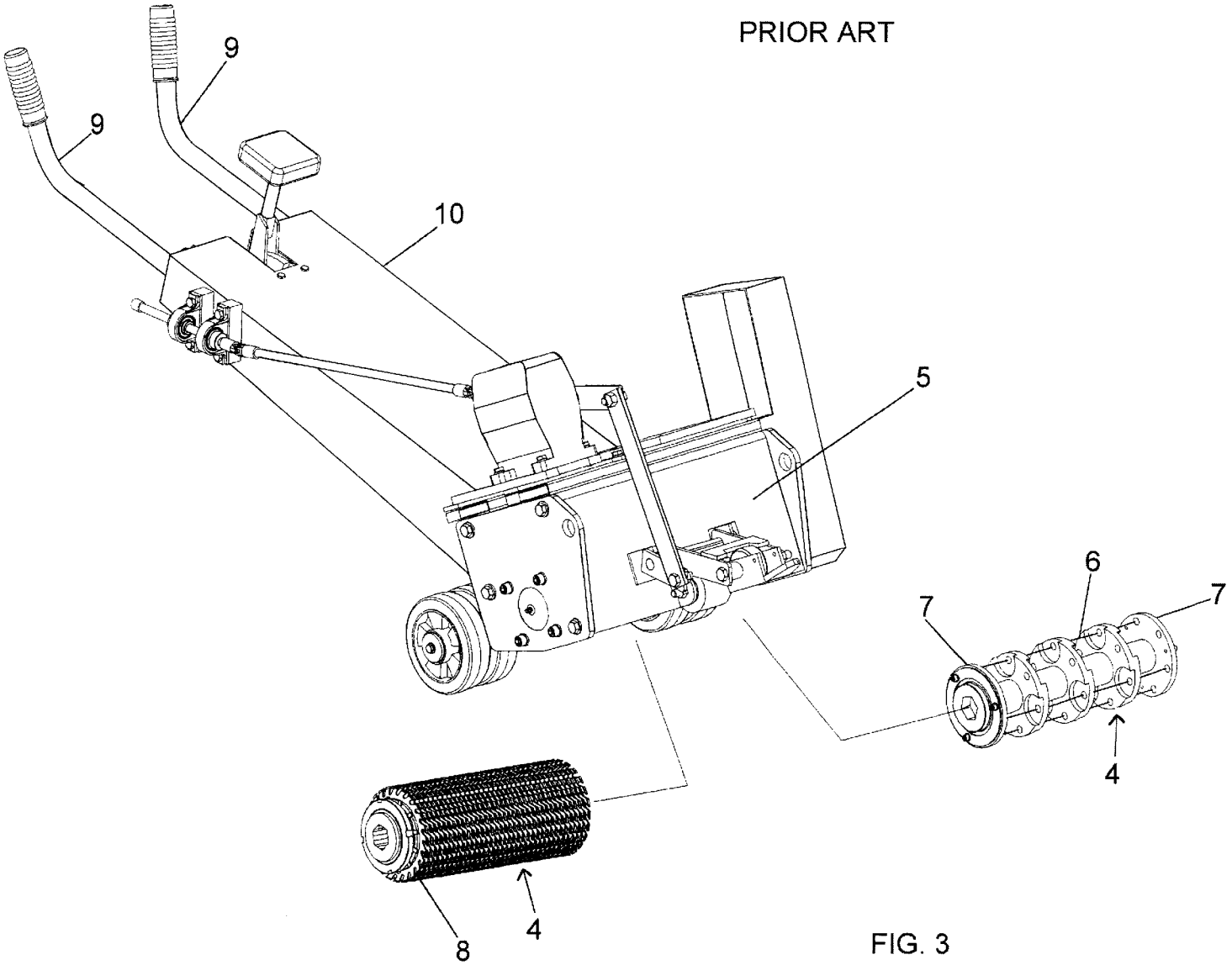
FIG. 3 is a perspective view of the traction milling machine illustrating alternative drum variations.

The milling apparatus, which prepares both flat and slatted floor by means of roughening or grinding, originates with a prior art traction milling machine manufactured by the SASE™ Company. Referring to FIG. 3, the prior art milling machine operates on the principle of a hydraulically operated rotating drum 4 having aggressive elements in contact with the floor surface. The drum 4 is attached to the frame 5 of the milling machine. The drum is comprised of regularly spaced rods 6 around the periphery of the drum attached at either end to side drum elements 7. A plurality of teeth 8 having spacers therebetween are fitted onto the rods. The rotation of the drum 4 in abrasive contact with the floor surface roughens the floor surface.

The traction milling machine referred to above is not originally configured for the special purpose contemplated by the present invention, and it will not work satisfactorily without the inclusion of the improvements, modifications and features described hereinafter. In particular, the prior art traction milling machine is hand-operated and strongly chatters and bangs along its course pulling the operator behind it. As such, in no time at all it becomes difficult to use the machine to properly prepare a floor surface of any significant size maintaining the required uniformity and consistency.

The present invention is capable of roughening floor surfaces having a large surface area. The operator sits on a seat attached to the motorized cart 1 and steers the traction milling machine 2 over the floor surface to be prepared. The motorized cart 1 has a hydrostatic drive mechanism by means of which the forward pulling traction milling machine 2 may be controlled and restrained by the operator or propelled forwardly and rearwardly as required. The cart 1 is attached at its forward end to the milling machine by means of a specialized articulated hitch 3. The hitch 3 and its function and operation is described in greater detail elsewhere in the specification with reference to FIGS. 4 and 5. Thus, the operation by the operator of the cart's hydrostatic drive permits the milling machine to range over the floor surface to be prepared as dictated and required by the operating conditions and job to be performed.

The milling apparatus is made steerable by providing the traction milling machine 2 with outwardly and rearwardly extending handles 9 attached to the frame extension 10. The manipulation of the steering handles by the operator, in cooperation with the specialized articulated hitch, work to steer the milling apparatus. During operation, the rear wheels 26 of the traction milling machine 2 function as the front wheels of the motorized cart 1.

Figure 4:
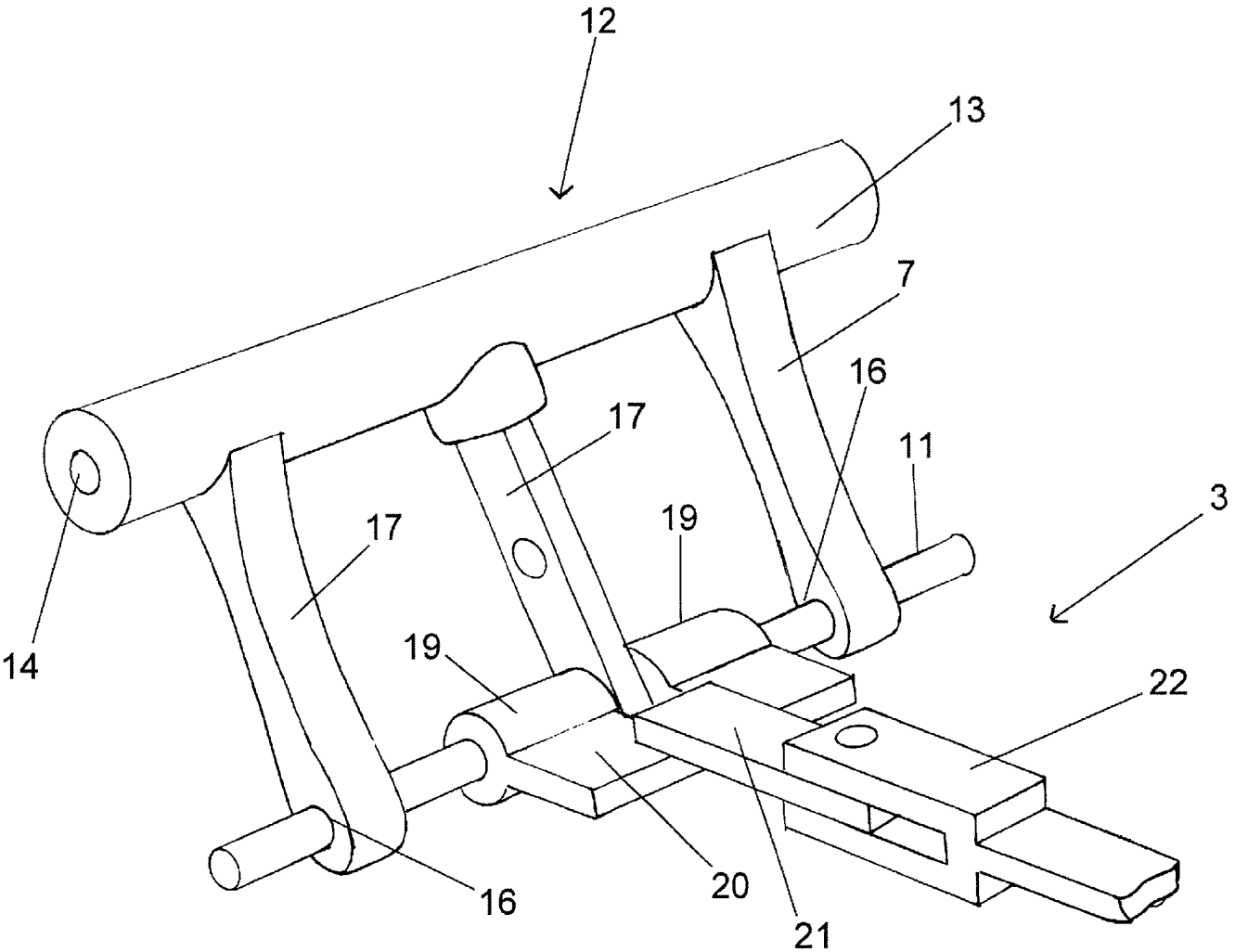
FIG. 4 is a sectional perspective of the view of the crank and specialized articulated hitch.
Figure 5:
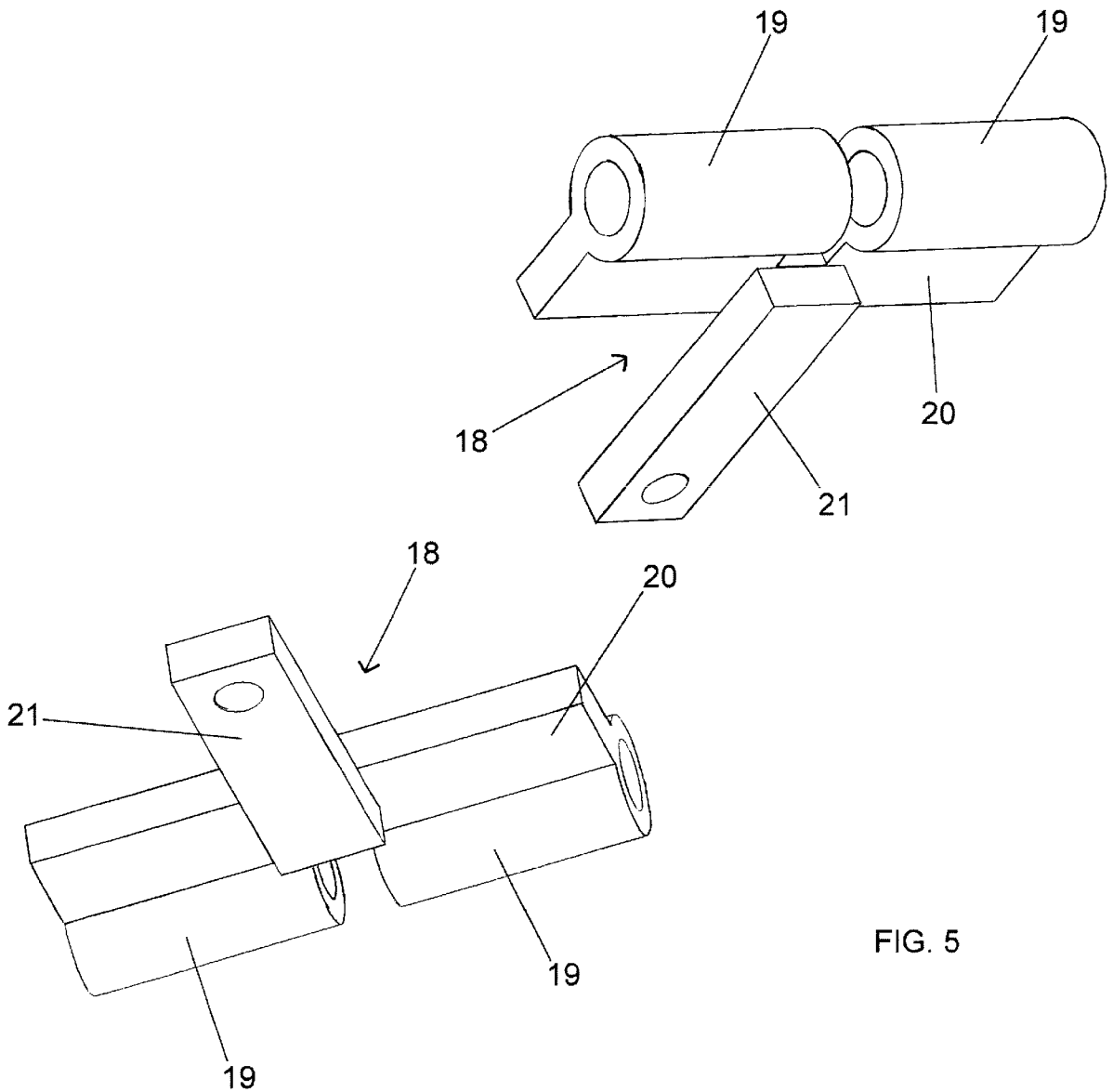
FIG. 5 is a perspective view of the weight transfer portion of the specialized articulated hitch.

Referring to FIGS. 4 and 5, the specialized articulated hitch 3 is used to transfer a portion of the weight of the motorized cart 1 and operator onto the rear wheels 26 of the traction milling machine 2. This transfer and use of additional weight enables the traction milling machine 2 to more effectively and efficiently track along its path on the floor, such that the drum 4 is in continuous contact with the floor surface without undue chatter or bounce. This achieves a more consistent finish to the floor surface.

Referring again to FIGS. 4 and 5, the rear axle 11 of the traction milling machine is pivotally attached to the frame extension 10 by means of a crank 12. The crank 12 has a base 13 having a longitudinal bore 14 made therethrough. The base 13 of the crank 12 is pivotally attached to the frame extension by means of passing a shaft 15 (not shown) through the longitudinal bore and suitably attaching the ends of the shaft 15 to the frame extension. Thus secured, the crank 12 may now pivot about the shaft 15.

To effect weight transfer to the traction milling machine 2, a specialized articulated hitch 3 is used in combination with the crank 12. Referring further to FIGS. 4 and 5, it should be noted that the rear wheel axle 11 passes through aligned bore holes 16 provided in the ends of the crank arms 17. The weight transfer portion 18 of the articulated hitch has a spilt bored shaft 19 each portion having a bore hole 27 having a diameter slightly larger that the diameter of the rear axle 11. The split portions are secured by means of welding to a base flange 20 to which is also welded tongue 21 for attachment to the complementary portion 22 of the hitch.

The weight transfer is achieved by means of mounting the weight transfer portion 18 of the hinge onto the rear axle 11 by means of aligning the split shaft 19 bore holes 27 with the bore holes 16. The rear axle 11 passes through the entire assembly to retain the weight transfer portion 18. The complementary hitch portion 22 secures within its unshaped jaws 28 the tongue 21 and the entire hitch assembly is pinned. By this means, the weight of the cart and operator is transferred to rear axle 11 of the traction milling machine.

The traction milling machine has forward wheel means and rearward wheel means each of which is vertically adjustable with reference to the frame. The forward wheel means selectively and alternatively consists of a vertically adjustable wheel (not shown) or ski 29 which is lowered by the operator into engagement with the floor by means of the linkages shown variously in FIGS. 2, 6, 7 and 8. Once the wheel or ski 29 is lowered into position, the linkage is further used to obtain the desired height of the wheel or ski with reference to the frame. It is considered that the adjustment means and linkages are adequately described and illustrated in the Figures. For greater certainty, the rotation of the articulated shaft 30 operates a worm gear located within housing 31 to pivot and thereby raise or lower the crank element 32 attached to the frame assembly 33 housing the wheel or ski.

Figure 9B:
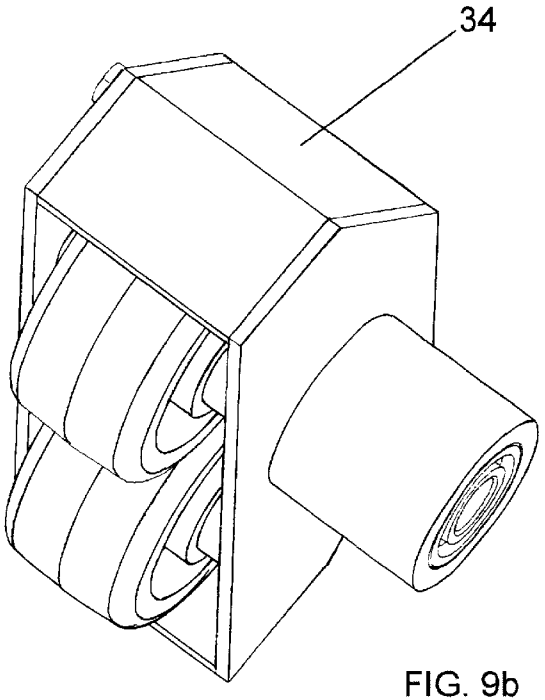
FIG. 9 is a perspective view of the wheeled dolly.
Figure 9A:
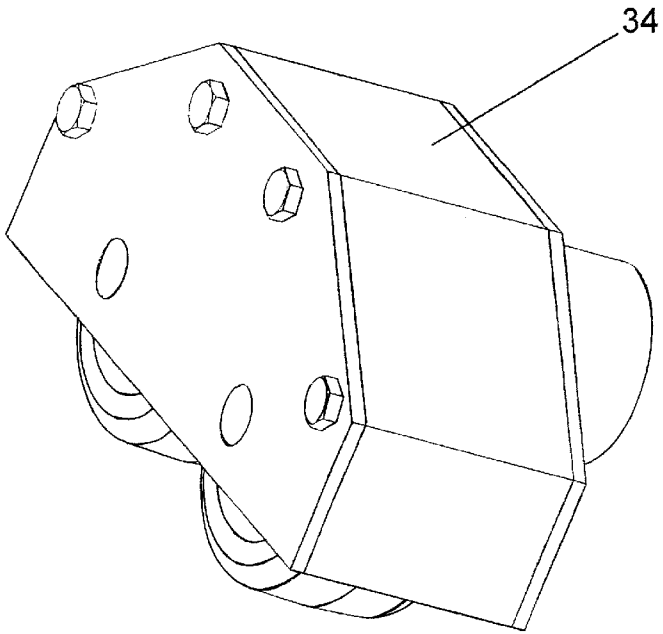
Figure 10:
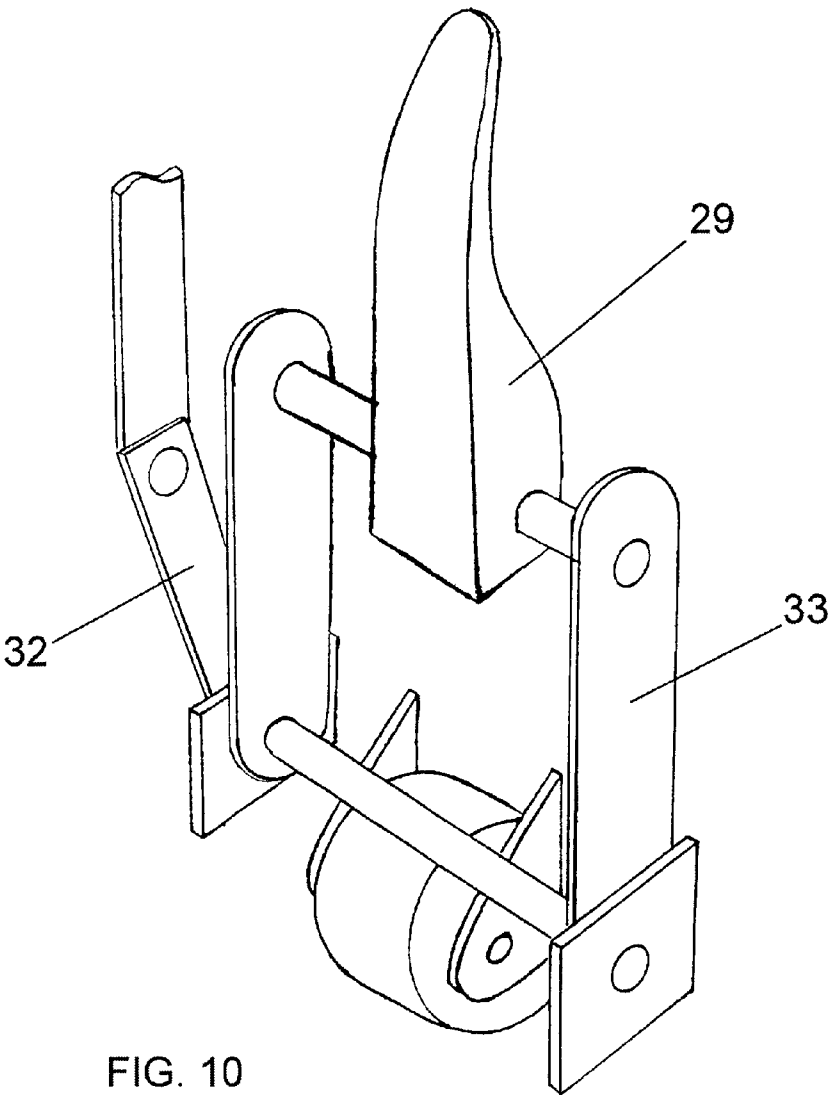
FIG. 10 is a partial sectional perspective view of the ski element and linkage.

The rearward wheel means ordinarily consist of a pair of wheels placed on opposing ends of the axle 11 in combination with a two wheel dolly arrangement as shown in FIG. 9. As can be seen, the dolly arrangement consists of two tandem wheels within a rigid frame housing 34 which has a suitable adapter for attachment onto the end of the axle 11. The entire assembly is shown at 35 in FIG. 8. The rearward wheel means are vertically adjustable with reference to the frame by means of the particular linkage arrangement shown in FIGS. 2, 6 and 7.

Figure 6:
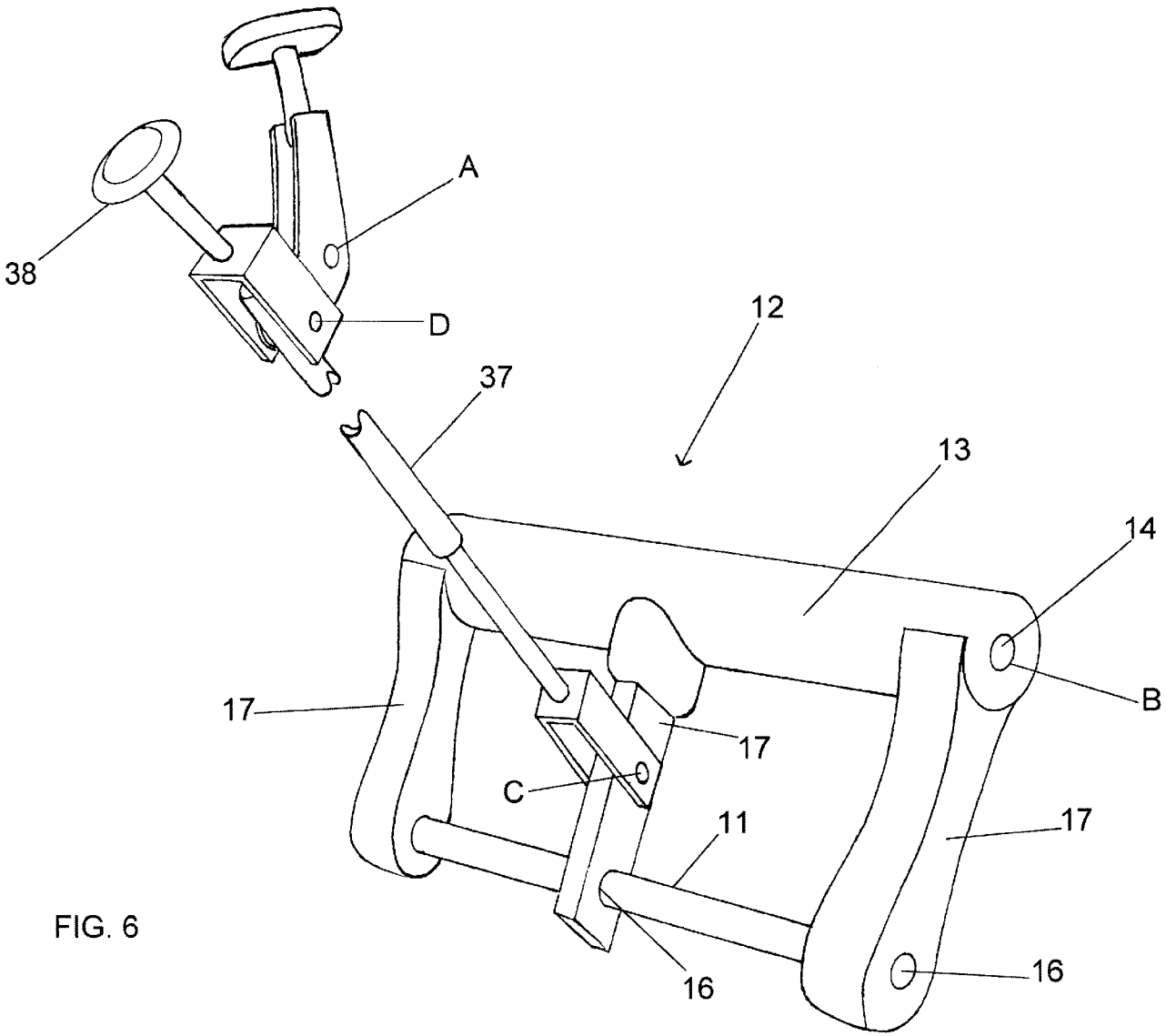
FIG. 6 is a sectional perspective view of the crank and rear vertical height adjustment linkage.
Figure 7:
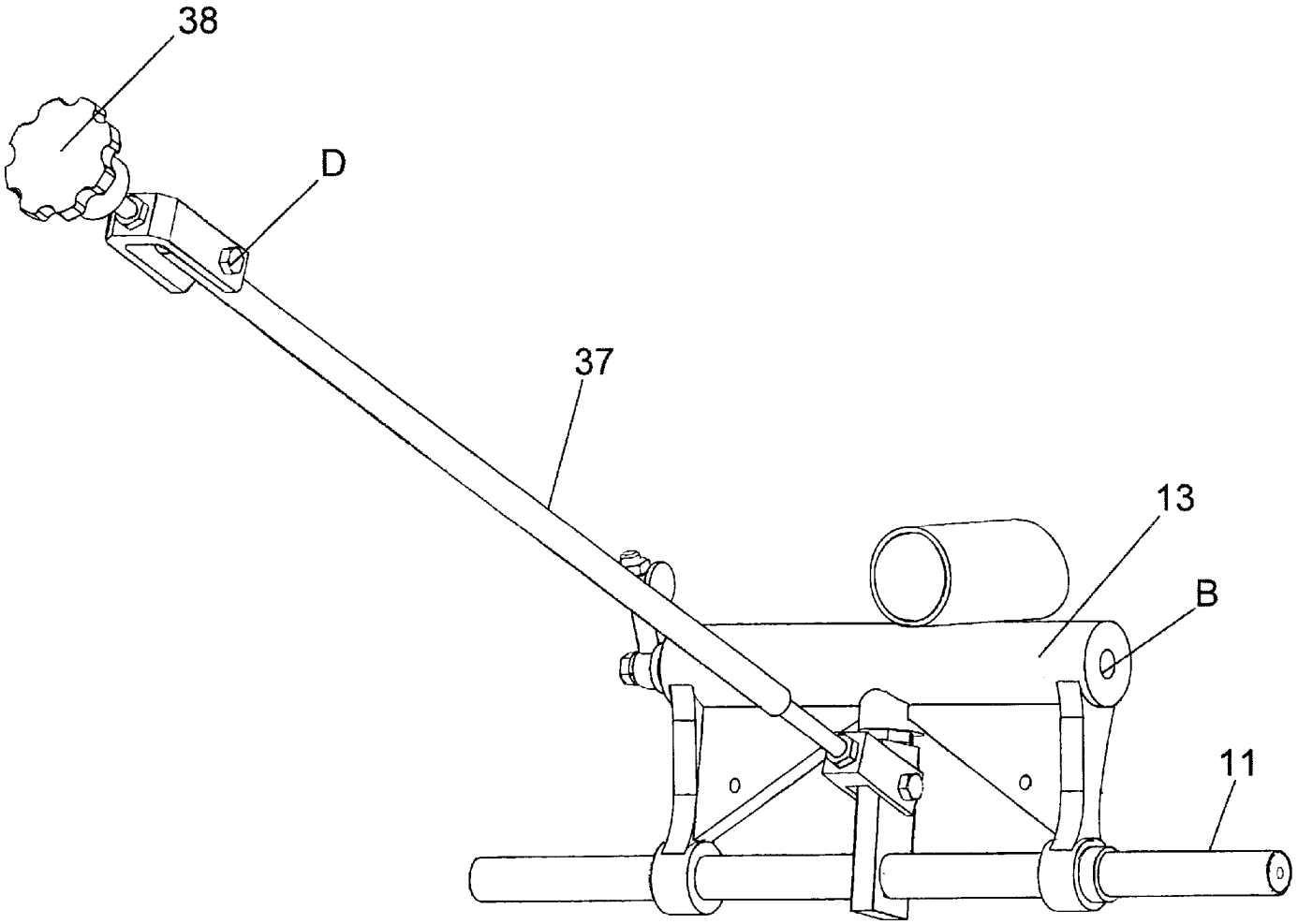
FIG. 7 is a partial sectional perspective view of the crank and rear vertical height adjustment linkage.
Figure 8:
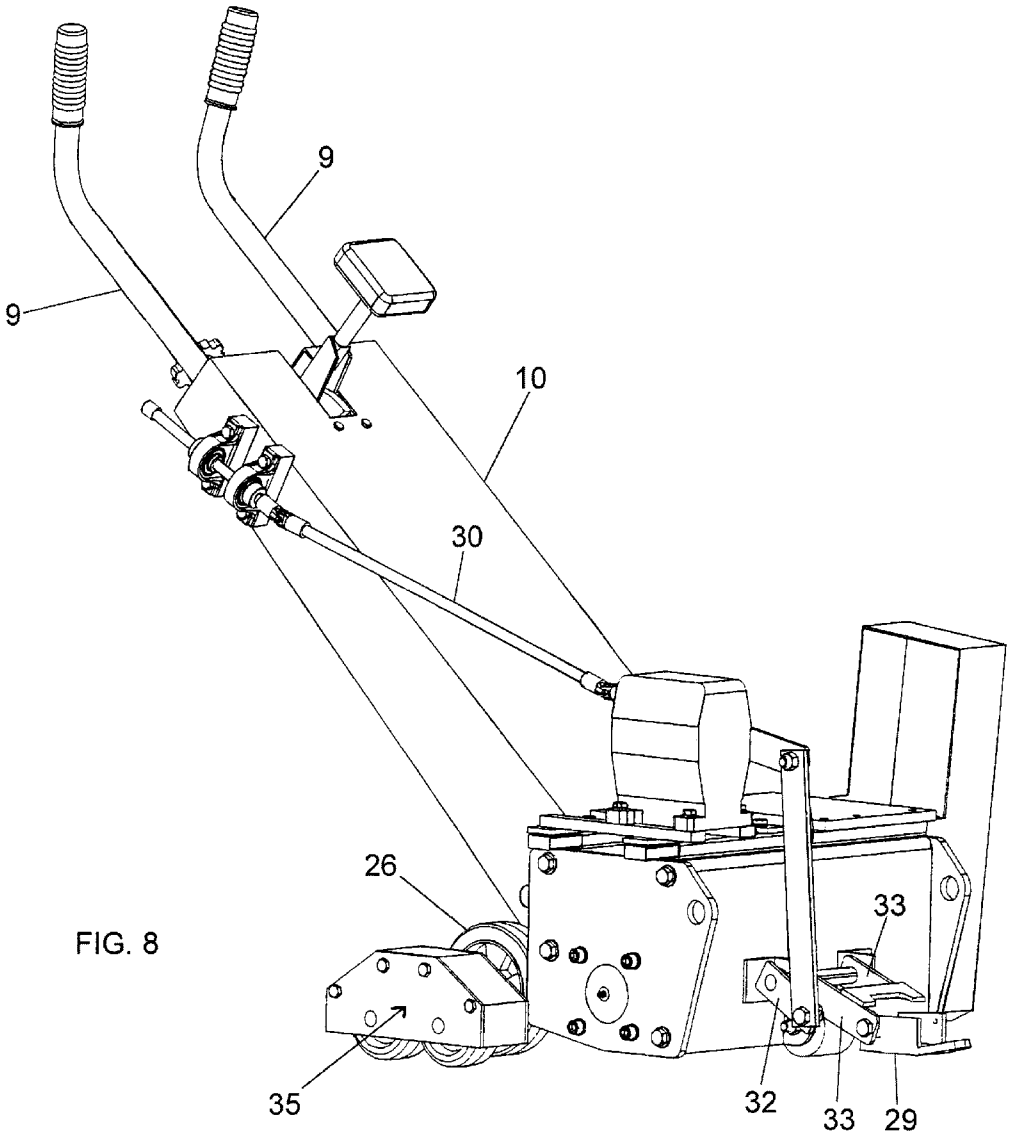
FIG. 8 is a perspective view of a traction milling machine illustrating the forward vertical height adjustment means and ski element and wheeled dolly.

In particular, with reference to FIGS. 6 and 7 the pinned linkage parallelogram ABCD is attached to the frame extension 10 at pivot points A and B. In combination with the pivot point attachments at C and D, the handle 36, in combination with suitable positioning means, is moved to raise or lower the wheels with reference to the frame 5. In effect, a parallelogram linkage is described and shown in the drawings.

Additionally, a linkage member 37 can be made to telescope for fine adjustment which is achieved by turning the handle 38 in a clockwise or counter clockwise direction to thereby lengthen or shorten the telescoping member 37.

As can be seen, the forward wheel means and rear wheel means are designed to ensure that the traction milling machine remains in level contact with the floor which is being prepared regardless of the type of floor surface. The ski 29 is particularly effective for this purpose on slatted floor surfaces. Variously, the ski which is operated to pivot downwardly by means of the linkage is long enough to ride over the slats and not cause any consequent bouncing of the machine whether travelling longitudinally or transversely with reference to the slots. The ski is also wide enough to not fall into the slots between the slat flooring. The result of the dolly arrangement described earlier in the specification is that at least two of the three wheels on each side of the traction milling machine are always in contact with the top surface of a slat. The object is to prevent any of the wheels falling into a slot, again regardless of whether the traction milling machine is being operating longitudinally or transversely with reference to the slats.

Additionally, the motorized cart may be adapted with a generator to provide electricity for lights suitably attached on the milling apparatus by means of magnets or the like to ensure proper illumination when operating in dark barn conditions. As well, a vacuum attachment may be provided to collect most concrete particles and control the dust generated by the operation of the milling apparatus.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claim.

Since many possible embodiments may be made of the invention without departing from the scope thereof, it is to be understood that all matter herein set forth or shown in the accompanying drawings is to be interpreted as illustrative and not in a limiting sense.

Having described the invention, what is claimed is:

1. A milling apparatus for preparing concrete floor surfaces comprising a rear wheeled motorized cart connected in tandem to a traction milling machine: said traction milling machine having a frame and drum mounted on said frame for milling engagement with said floor surface; forward wheel means attached to the front end of said frame and forward adjustment means for vertically adjusting said forward wheel means with reference to the frame; rearward wheel means comprising an axle and pair of spaced apart wheels mounted on said axle, said axle attached to the rearward end of said frame and rearward adjustment means for vertically adjusting said rear wheel means with reference to the frame; said tandem connection comprising a horizontally articulated hitch having a first portion pivotally mounted on said axle and a second complementary portion attached to said cart and said first portion; said milling apparatus having an operator seat and steering means for said operator; and motor means for powering said cart and said traction milling machine.

2. The milling apparatus as claimed in claim 1 wherein said first portion of the articulated hitch comprises a tongue member and said second complementary portion comprises a vertically aligned u-shaped member and wherein said attachment between said first and second portions consists of placement of said tongue member within said u-shaped member and securing said tongue member within said u-shaped member by means of a pin.

3. The milling apparatus as claimed in claim 2 wherein said first portion includes a flange having a circular bore having a diameter greater than the diameter of said axle.

4. The milling apparatus as claimed in claim 3 wherein said forward wheel means comprises at least one wheel.

5. The milling apparatus as claimed in claim 4 wherein said rear wheel means comprises a dolly arrangement at each end of said axle comprising a ridged frame housing containing two tandem aligned wheels said ridged frame housing having means for attachment to the end of said axle.

6. The milling apparatus as claimed in claim 5 wherein said drum comprises regularly spaced rods around the periphery of said drum and attached at each end thereof to side drum elements and having a plurality of teeth having spacers therebetween fitted onto said rods.

7. The milling apparatus as claimed in claim 5 wherein said drum comprises a plurality of vertically aligned sawblades.

8. The milling apparatus as claimed in claim 3 wherein said forward wheel means comprises a ski shaped sliding element.

9. The milling apparatus as claimed in claim 8 wherein said rear wheel means comprises a dolly arrangement at each end of said axle comprising a ridged frame housing containing two tandem aligned wheels said ridged frame housing having means for attachment to the end of said axle.

10. The milling apparatus as claimed in claim 9 wherein said drum comprises regularly spaced rods around the periphery of said drum and attached at each end thereof to side drum elements and having a plurality of teeth having spacers therebetween fitted onto said rods.

11. The milling apparatus as claimed in claim 9 wherein said drum comprises a plurality of vertically aligned saw-blades.

* * * * *